US012188188B2

(12) United States Patent
Kopf et al.

(10) Patent No.: US 12,188,188 B2
(45) Date of Patent: Jan. 7, 2025

(54) METHOD FOR PROVIDING INFORMATION RELATED TO THE COMPACTION STATE OF A SOIL WHEN PERFORMING A COMPACTION OPERATION WITH A SOIL COMPACTOR

(71) Applicant: Hamm AG, Tirschenreuth (DE)

(72) Inventors: Fritz Kopf, Vienna (AT); Johannes Pistrol, Vienna (AT); Mario Hager, Zell am Pettenfirst (AT); Dietmar Adam, Brunn am Gebirge (AT); Tobias Fehr, Mitterteich (DE); Werner Völkel, Neustadt (DE)

(73) Assignee: Hamm AG, Tirschenreuth (DE)

( * ) Notice: Subject to any disclaimer, the term of this patent is extended or adjusted under 35 U.S.C. 154(b) by 683 days.

(21) Appl. No.: 17/492,974

(22) Filed: Oct. 4, 2021

(65) Prior Publication Data

US 2022/0106744 A1 Apr. 7, 2022

(30) Foreign Application Priority Data

Oct. 6, 2020 (DE) ..... 10 2020 126 084.9

(51) Int. Cl.
*E01C 19/28* (2006.01)
*E01C 3/04* (2006.01)
*E01C 19/26* (2006.01)

(52) U.S. Cl.
CPC ..... *E01C 19/288* (2013.01); *E01C 3/04* (2013.01); *E01C 19/266* (2013.01); *E01C 19/286* (2013.01)

(58) Field of Classification Search
CPC ..... E01C 19/288; E01C 3/04; E01C 19/286; E01C 19/266
See application file for complete search history.

(56) References Cited

U.S. PATENT DOCUMENTS 5,727,900 A * 3/1998 Sandstrom ..... G01P 15/18 702/56
9,534,995 B2 * 1/2017 Stoeckel ..... E02D 1/022
(Continued)

FOREIGN PATENT DOCUMENTS

CN 1042992 A 6/1990
CN 101281011 A 10/2008
(Continued)

OTHER PUBLICATIONS

Wikipedia, "Iteration", downloaded Aug. 3, 2023, https:1/de.wikIpedia.orglwiki/Iteration.
(Continued)

*Primary Examiner* — Abigail A Risic
(74) *Attorney, Agent, or Firm* — RANKIN, HILL & CLARK LLP

(57) ABSTRACT

A method for providing information related to the compaction state of soil when performing a compaction operation with a soil compactor includes: a) detecting a vertical acceleration and a horizontal acceleration of a vibratory roller when moving a soil compactor over soil to be compacted, b) determining a measurement relationship between a ground contact force and a deflection of the vibratory roller for one vibration cycle using the vertical acceleration and horizontal acceleration detected in operation a), c) determining a simulation relationship between the ground contact force and the deflection for one vibration cycle using a ground model taking into account at least one simulation parameter, d) comparing the simulation relationship to the measurement relationship, and e) determining that a default value of the at least one simulation parameter taken into account in the ground model substantially represents a corresponding soil parameter of the soil to be compacted
(Continued)

when the simulation relationship substantially corresponds to the measurement relationship.

15 Claims, 3 Drawing Sheets

(56) References Cited

U.S. PATENT DOCUMENTS

| | | | | |
|---|---|---|---|---|
| 9,645,071 | B2 * | 5/2017 | Pistrol | E01C 19/23 |
| 2004/0035207 | A1 | 2/2004 | Hamblen et al. | |
| 2009/0126953 | A1 * | 5/2009 | Anderegg | E02D 3/074 172/1 |
| 2013/0261998 | A1 | 10/2013 | Anderegg et al. | |
| 2016/0103051 | A1 | 4/2016 | Corcoran | |
| 2019/0382966 | A1 | 12/2019 | Laugwitz et al. | |

FOREIGN PATENT DOCUMENTS

| | | | |
|---|---|---|---|
| CN | 103534558 | A | 1/2014 |
| CN | 104878674 | A | 9/2015 |
| CN | 105696445 | A | 6/2016 |
| CN | 106812050 | A | 6/2017 |
| DE | 2018219 | A1 | 11/1971 |
| DE | 69423048 | | 9/2000 |
| DE | 102011076131 | A1 | 11/2012 |
| DE | 102015007369 | | 12/2015 |
| DE | 112015004191 | | 6/2017 |
| DE | 112015004191 | T5 | 6/2017 |
| EP | 0 723 616 | | 2/2000 |
| EP | 0932726 | B1 | 8/2000 |
| EP | 1516961 | B1 | 12/2013 |
| EP | 3431658 | | 1/2019 |
| JP | 2015094731 | A | 5/2015 |
| JP | 2015094733 | A | 5/2015 |
| JP | 2019-522134 | | 8/2019 |
| WO | 9510664 | | 4/1995 |

OTHER PUBLICATIONS

Wikipedia, "Numerische Mathematik", downloaded Aug. 3, 2023, https:1/de.wikipedia.org/wiki/Numerische_Mathematik.

White, David J., "A Review of Roller-Integrated Compaction Monitoring Technologies for Earthworks" Earthworks Engineering Research Center (EERC), Apr. 1, 2010, 36 pages.

Hager, Mario, "Messwerte der Flachendeckenden Dynamischen Verdichtungskontrolle (FDVK) im theore-tischen und experimentellen Vergleich" Apr. 1, 2015, (includes English translation of relevant portions), 96 pages.

Kopf, F. et al., "Innovative Ideen bei Messungen am Walze-Boden-Interaktionssystem bei der dyna-mischen Verdichtung" Anniversary Symposium—40 Years of Roller Integrated Continuous Compaction Control (CCC), Nov. 29, 2018, (includes English translation of relevant portions), 5 pages.

Grabe, J., "Fortlaufend Inverse Berechnung der Bodensteifigkeit aus dem Schwingungsverhalten einer fahrbaren Vlbralionswalze" Archive of Applied Mechanics 63, May 14, (includes English translation of relevant portions), 8 pages.

Krober, Wolfgang, "Schwingungstechnische Grundlagen der Flachendeckenden Verdichtungskontrolle" Hochschule Koblenz; Jubilaumssymposium 40 Jahre Flachendeckende Verdichtungskontrolle, Nov. 29, 2018, (includes English translation of relevant portions), 23 pages.

European Patent Office, Extended Search Report issued for EP 21194462, Mar. 4, 2022, 5 pages.

China National Intellectual Property Administration, Search Report for CN202111167875.7, Mar. 29, 2024, 3 pages.

Grabe, Jurgen: "Experimentelle und theoretische Untersuchungen zur flachendeckenden dynamishcen Verdichtungskontrolle" 1992 (relevant excerpt corresponds to EP0 723 616 at paragraph 7).

* cited by examiner

METHOD FOR PROVIDING INFORMATION RELATED TO THE COMPACTION STATE OF A SOIL WHEN PERFORMING A COMPACTION OPERATION WITH A SOIL COMPACTOR

The present invention relates to a method for providing information related to the compaction state of a soil when performing a compaction operation with a soil compactor.

Soil compactors used for performing such compaction operations, for example for compacting loose material in earthwork or, for example, asphalt material or the like in road construction, generally comprise at least one vibratory roller with an imbalance arrangement rotating about a roller rotation axis of the at least one vibratory roller. To be able to provide information about the state of movement of such a vibratory roller, an acceleration detection arrangement is provided in association with the at least one vibratory roller of such a soil compactor for detecting a vertical acceleration of the vibratory roller substantially orthogonal to the soil to be compacted and a horizontal acceleration of the vibratory roller substantially parallel to the soil to be compacted.

Providing an imbalance arrangement rotating about the roller rotation axis superimposes a dynamic load component on the static load on the soil generated by the weight of the compactor roller or vibratory roller and the weight of the soil compactor bearing thereon when the soil compactor passes over it, which substantially influences the compaction of the soil generated when the soil compactor passes over the soil. Particularly, the rotation of such an imbalance arrangement can operate a vibratory roller in such a way that it periodically lifts off from the soil to be compacted and respectively periodically impacts on it.

Detecting the vertical acceleration, i.e. the acceleration of such a vibratory roller substantially orthogonal to the soil to be compacted, and the horizontal acceleration, i.e. the acceleration of the vibratory roller substantially parallel to the soil to be compacted, can provide information about the state of movement and about the ground contact force acting between the soil and the vibratory roller during the phases in which the vibratory roller is in contact with the soil to be compacted. This information can be used to provide information in the context of an area-wide dynamic compaction control (FDVK), which is related to the degree of compaction of the soil to be compacted, for example. Based on this information, it can be determined whether a soil to be compacted is already sufficiently compacted or whether further passes with a soil compactor are required. Furthermore, this information can be located and stored or documented for quality assurance purposes.

It is the object of the present invention to provide a method for providing information related to the compaction state of a soil when performing a compaction operation with a soil compactor, with which information representing the state of the compacted soil can be provided with extended information content and higher precision.

According to the present invention, this object is achieved by a method for providing information related to the compaction state of a soil when performing a compaction operation with a soil compactor, wherein the soil compactor comprises at least one vibratory roller having an imbalance arrangement rotating about a roller rotation axis of the at least one vibratory roller, wherein an acceleration detection arrangement is provided in association with the at least one vibratory roller for detecting a vertical acceleration of the vibratory roller substantially orthogonal to the soil to be compacted and a horizontal acceleration of the at least one vibratory roller substantially parallel to the soil to be compacted.

The method according to the invention comprises the operations:

a) detecting the vertical acceleration and the horizontal acceleration of the at least one vibratory roller when the soil compactor moves over the soil to be compacted, b) determining a measurement relationship between a ground contact force and a deflection of the vibratory roller for at least one vibration cycle using the vertical acceleration and horizontal acceleration detected in operation a), c) determining a simulation relationship between the ground contact force and the deflection for at least one vibration cycle using a ground model taking into account at least one simulation parameter, d) comparing the simulation relationship determined in operation c) for at least one vibration cycle with the measurement relationship determined in operation b) for at least one vibration cycle, e) determining that a default value of the at least one simulation parameter taken into account in the ground model substantially represents a corresponding soil parameter of the soil to be compacted, if the comparison performed in operation d) indicates that the simulation relationship determined for at least one vibration cycle substantially corresponds to the measurement relationship determined for at least one vibration cycle.

In the method according to the invention, the movement of the vibratory roller in a vibration cycle, which is determined taking into account the detected acceleration of a vibratory roller and is related to the ground contact force acting between the vibratory roller and the soil to be compacted, i.e., for example, during a complete revolution of the imbalance arrangement, is compared to a movement of the vibratory roller or the ground contact force acting between said roller and the soil in the course of a vibration cycle, which is determined taking into account a ground model and at least one simulation parameter used in the ground model.

Then, if a sufficiently good agreement is achieved of the relationship between the ground contact force of the deflection based on the ground model, i.e. the simulation relationship, and the relationship based on the detection of the acceleration and thus reflecting the actual state of movement of the vibratory roller, i.e. the measurement relationship, which can be determined in a best-fit process, for example, it is assumed that the ground model with the simulation parameter(s) taken into account therein represents the actual state of the compacted soil with high precision. This, in turn, can serve as a basis for the plausible assumption that the simulation parameter(s) taken into account in the ground model is/are in very good agreement with the value(s) of the respective parameter(s) of the actually compacted soil with respect to a respective parameter value.

The presence of a very good agreement between the simulation relationship and the measurement relationship thus confirms the selection made in the definition of the ground model of a respective parameter value of the simulation parameter(s) taken into account in the model. Such a simulation parameter or several such parameters taken into account in the model can then be taken into account and stored within the framework of an area-wide dynamic compaction control as variables reflecting the condition of the compacted soil or documented in another way, also in connection with the locations or positions on the compacted soil in association with which the respective parameter values were determined.

For the method according to the invention to take into account that, when carrying out a compaction process, a soil compactor moves forward in a direction of movement and, therefore, an effective direction or working direction of the vibratory roller periodically moving up and down under the action of the imbalance arrangement will deviate from an exactly vertical direction when penetrating a soil to be compacted, it is proposed that, in operations b) and c), the deflection in a working direction of the vibratory roller substantially corresponding to a direction of the maximum ground contact force is taken into account.

In the case of a periodic up and down movement of a vibratory roller and a periodic lifting of the vibratory roller from the soil accompanying this movement, a correspondingly increasing contact area is produced after contact occurs between the vibratory roller and the soil as the vibratory roller penetrates the soil. The deeper the vibratory roller penetrates or can penetrate into the soil, the larger the contact area extended in the axial direction of a roller shell of the vibratory roller and in the circumferential direction. It is therefore further proposed that operation c) comprise an operation c1) for determining a contact perimeter length of the vibratory roller in the course of a vibration cycle. The contact perimeter length is a quantity which, in connection with the axial extension of the contact surface between the vibratory roller and the soil, describes the extent to which the vibratory roller penetrates the soil, and can therefore form a simulation parameter to be taken into account in the ground model in accordance with the present invention.

For this purpose, for example, the contact perimeter length is determined in operation c1) on the basis of the vertical acceleration and horizontal acceleration determined in operation a) and on the basis of a movement speed or travel speed of the soil compactor in a soil compactor movement direction. The contact perimeter length can be calculated based on the vertical acceleration and the horizontal acceleration and based on the movement speed of the soil compactor in its direction of movement, taking into account the geometric conditions of the soil into which the vibratory roller penetrates. The contact perimeter length, which can be taken into account as one of the simulation parameters in the ground model to be set up according to the invention, is thus a variable that is not selected arbitrarily when defining the ground model, but is derived mathematically from the actually present and sensor-detected state of movement of the soil compactor or the vibratory roller. This calculation can be based on various simplifying assumptions, such as the assumption that the vibratory roller moves parallel to the ground, i.e., that it penetrates the ground to the same extent over its entire axial length. In this case, the contact area between the floor and the vibratory roller can be assumed to be the product of the contact perimeter length and the axial length of the roller shell. In the case of more complex motion models that can nevertheless be taken into account mathematically, such as the assumption that the vibratory roller wobbles and does not penetrate the soil to the same depth in all length regions, different values can be assumed for the contact perimeter length for different axial regions of the vibratory roller. This can be done, for example, by taking into account acceleration values recorded at both axial ends in the vertical direction and in the horizontal direction.

When using the contact perimeter length as one of the input variables of the ground model, it is a particular advantage that the contact perimeter length mathematically derived from the actually existing state of motion of the soil compactor and the vibratory roller takes into account parameters characterizing these states of motion, such as, for example, the speed of movement of the soil compactor as well as the rotational speed and the direction of rotation of the imbalance arrangement. The model, or the comparison with variables derived from the acceleration of a vibratory roller, which is carried out using such a model, is thus independent of such variables characterizing the state of movement, such that the method according to the invention can be used to make a primary statement about the condition of the soil, which, for example, is not or hardly dependent on the speed at which the soil compactor moves over the soil to be compacted when carrying out the compaction process.

In operation c1), the contact perimeter length can be determined with a front perimeter length section preceding a contact center in a direction of movement of the soil compactor and a rear perimeter length section trailing the contact center in the direction of movement of the soil compactor. An asymmetry parameter representing the condition of the soil can be formed based on a length of the front perimeter length section and a length of the rear perimeter length section. Due to the movement of a soil compactor over the soil to be compacted, such an asymmetry is created between the front perimeter length section and the rear perimeter length section. This asymmetry, for example the difference between the lengths of the two perimeter length sections or the ratio of the lengths of the two perimeter length sections to each other, depends on the condition of the soil over which a soil compactor is moving and can thus also be taken into account or recorded as a parameter characterizing the condition of the soil. This parameter itself does not constitute an input variable of the ground model to be defined by a plausible assumption, but can be mathematically determined when determining the contact perimeter length, taking into account the geometric conditions of the soil and the state of movement of the soil compactor or the vibratory roller specified above based on measured values and provides, for example, a variable which can be used in conjunction with one or more simulation parameters to be specified as input variables for the model as characterizing the condition of the soil or which can also be used for a plausibility check of simulation parameters specified for the model.

The modulus of elasticity of a soil is a physical quantity substantially characterizing its condition, particularly its state of compaction, and can therefore form a simulation parameter of the ground model according to an advantageous aspect of the present invention.

When a soil compactor passes over a soil to be compacted, this soil is compressed, wherein the soil generates a reaction force counteracting the load of the soil compactor and thus the compression. In the ground model to be set up according to the invention, therefore, a soil deformation behavior represented at least by a spring force component and a damper force component can be taken into account, and the operation c) can comprise an operation c2) for determining the spring force component, and can comprise an operation c3) for determining the damper force component, taking into account such a deformation behavior. It should be noted that other quantities influencing the deformation behavior, such as the mass of the deformed soil, can also be taken into account in such a ground model.

For operation c2), the spring-force component can be determined as a function of the elastic modulus of the soil and the contact perimeter length. Likewise, in the case of operation c3), the damper force component can be determined as a function of the elastic modulus of the soil and the contact perimeter length, for example also as a function of the deformation or penetration. Thus, two variables that significantly influence or represent the behavior of the soil find their way into the ground model.

For the method according to the invention to take into account that a loaded soil can behave differently in a loaded phase and a relief phase, particularly with regard to its spring force component, it is further proposed that the spring force component for a vibration cycle is determined in operation c2) with a first spring force component portion for a phase with increasing penetration depth of the vibratory roller into the soil and with a second spring force component portion for a phase with decreasing penetration depth of the vibratory roller.

Particularly, the different force behavior can be taken into account by determining, in operation c2), the second spring force component taking into account a relief stiffness factor in such a way that, in a transition from the phase of decreasing penetration depth of the vibratory roller to an out-of-contact phase, the spring force component and the damper force portion compensate each other substantially completely, wherein the at least one vibratory roller is substantially not in contact with the soil to be compacted in the out-of-contact phase. The relief stiffness factor can form a stiffness parameter representing the condition of the soil. Such a relief stiffness factor can thus express the different force behavior in a simple manner while taking into account fundamentally identical mathematical relationships for the spring-force component in the two sections, wherein the requirement that the two force components compensate each other at the time of transition to the out-of-contact phase represents an essential boundary condition for determining the relief stiffness factor.

The two force components in the ground model, i.e., the spring force component and the damper force component, may be provided as factors substantially determining the ground contact force, such that operation c) may comprise an operation c4) for determining the ground contact force for one vibration cycle based on the spring force component determined in operation c2) and the damper force component determined in operation c3).

If it is detected during operation e) that the deviation of the simulation correlation from the measurement correlation does not fall below a predetermined deviation threshold, which means that an excessive deviation is detected during the comparison between the two correlations, operations c) to e) can be repeated while changing at least one simulation parameter during the execution of operation c) until the deviation of the simulation correlation from the measurement correlation falls below the predetermined deviation threshold. Thus, an iterative approximation of the simulation relationship obtained from the simulation taking into account the ground model to the measurement relationship obtained exclusively taking into account measured data can be performed until they substantially match each other.

To further improve the agreement of a value for a simulation parameter obtained taking into account the ground model and the actually existing condition of the compacted soil for such a value of the simulation parameter, a correlation factor can be determined between the simulation parameter determined in operation e) as substantially representing the respective soil parameter and a measured value of the soil parameter of the compacted soil. For this purpose, for example, a soil, e.g. asphalt material, can be compacted in a test, and after a value for one or more simulation parameters resulting from the simulation is available, the soil thus processed can be examined under laboratory conditions or in in-situ comparison tests to determine the actually existing value of a respective soil parameter. A correlation factor linking these two values can then be determined from the deviation between the value resulting from the simulation or the ground model and the value determined by measurement, for example in the laboratory. If such a correlation factor is available based on an investigation, the simulation parameter determined in operation e) as substantially representing the corresponding soil parameter can be linked to such a known correlation factor in the method according to the invention for obtaining an actual value of a soil parameter.

To be able to take into account the information about the condition of the compacted soil provided during the execution of the method according to the invention still during the compaction operation, the operations a) to e) can be carried out repeatedly during the movement of the soil compactor when performing a compaction operation. The information about the condition of the soil can then be used in real time in a control process to operate a soil compactor in such a way that soil parameters are obtained for the soil to be compacted which meet requirements established before the compaction process is carried out.

Particularly, for the purposes of quality assurance, a data set with a plurality of positions on the soil to be compacted and the value of the at least one simulation parameter determined to be substantially representative of a soil parameter during the execution of operations a) to e) can be generated when a compaction process is carried out. Such a data set can then be used as the basis for documenting a compaction process that has been performed.

The present invention is described below with reference to the accompanying figures. Wherein.

Figure 1:
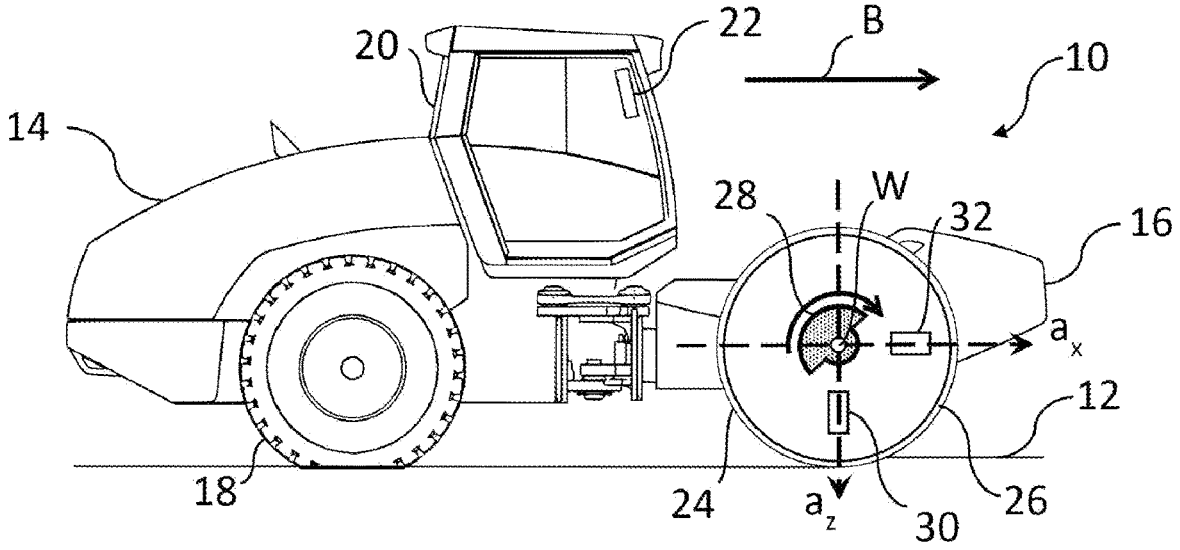
FIG. 1 shows a side view of a soil compactor in simplified form.

In FIG. 1, a soil compactor is generally designated 10. The soil compactor 10 moving in a direction of movement B on a soil 12 to be compacted is constructed with a rear carriage 14 and a front carriage 16 pivotally supported thereon. A drive unit and drive wheels 18 driven by the same for moving the soil compactor 10 in the direction of movement B or in the opposite direction are provided on the rear carriage 14. Furthermore, an operator's station 20 is provided on the rear carriage 14 for an operator operating the soil compactor 10. From the operator's station, the operator can operate the soil compactor 10 to perform a compaction operation, and information relevant to the compaction operation can be displayed to the operator on a display unit 22.

A compactor roller or vibratory roller 24 is supported on the front carriage 16 as a compaction tool so that it can rotate about a roller rotation axis W that is orthogonal to the drawing plane of FIG. 1. In the two axial end regions of the compactor roller 24 or of a shell 26 thereof, the latter is suspended via elastic suspension arrangements on the front carriage 16 in such a way that the vibratory roller 24 can be deflected transversely to the roller rotation axis W with respect to the front carriage 16. A drive motor may be associated with the compactor roller 24 for driving the same to rotate about the roller rotation axis W.

Such a deflection of the vibratory roller 24 can be caused by an imbalance arrangement 28 arranged inside the same with at least one unbalanced mass which can be driven to rotate about the roller rotation axis W and which has a center of mass eccentric to the roller rotation axis W. The rotation of the imbalance arrangement 28 about the roller rotation axis W and the centrifugal forces that occur and are transmitted to the vibratory roller 24 and act orthogonally to the roller rotation axis W generate a periodic deflection of the vibratory roller 24 with respect to the front carriage 16. This deflection or the forces acting on the vibratory roller 24 during rotation of the imbalance arrangement 28 can be detected by acceleration sensors 30, 32 associated with the vibratory roller 24. In this context, the acceleration sensor 30 may be configured or arranged to detect a vertical acceleration $a_z$, i.e., an acceleration that is directed substantially orthogonally to the surface of the soil 12 to be compacted. The acceleration sensor 32 may be configured or arranged to detect a translational horizontal acceleration $a_x$, which is an acceleration directed substantially parallel to the surface of the soil 12 to be compacted. For example, the two acceleration sensors 30, 32 may be provided on a bearing shell of a bearing rotatably supporting the vibratory roller 24 in one of its axial end portions with respect to the front carriage 16. It should be noted that, for example, such a pair of acceleration sensors 30, 32 may also be provided at both axial end regions of the vibratory roller 24 to be able to detect the accelerations or forces acting on the vibratory roller 24 in both axial end regions.

Figure 2:
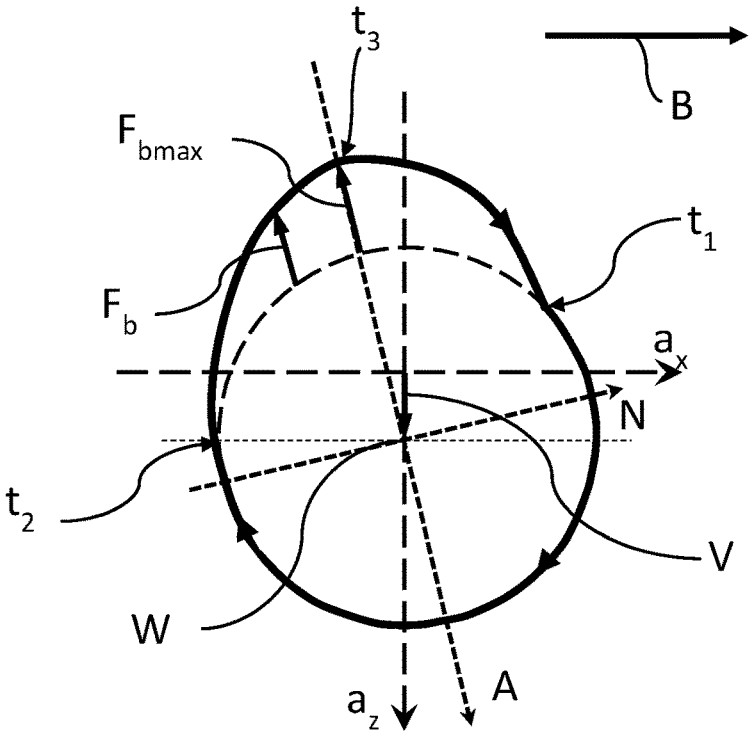
FIG. 2 is a diagram showing the accelerations occurring in the course of a vibration cycle on a vibratory roller of the soil compactor of FIG. 1 orthogonal to a surface of a soil to be compacted and parallel to this surface.

FIG. 2 illustrates the vertical acceleration $a_z$ and horizontal acceleration $a_x$ occurring through the acceleration sensors 30, 32 in the course of a vibration cycle, for example a complete revolution of the imbalance arrangement 28. In this case, the diagram of FIG. 2 shows an operating condition in which, due to the forces generated by the imbalance arrangement 28, the vibratory roller 24 periodically lifts temporarily from the soil 12 to be compacted during each vibration cycle and subsequently strikes the soil again, penetrating the soil 12 to be compacted.

At time $t_1$, the vibratory roller 24 lifts off the soil 12 to be compacted, such that the force acting on the vibratory roller 24 is substantially determined from the product of the mass of the vibratory roller 24 and the acceleration occurring at each time, as well as from the force from the vibratory excitation and from the static axle load. At time $t_2$, the vibratory roller 24 again comes into contact with the soil 12 to be compacted and, in the course of this movement, increasingly penetrates the soil 12, compacting it in the process. In this phase, in which the vibratory roller 24 is in contact with the soil 12, i.e. between the times $t_2$ and $t_1$, a ground contact force $F_b$ acts between the ground 12 and the vibratory roller 24, which is substantially also determined by the reaction generated by the soil 12 to the load applied by the vibratory roller 24. As the vibratory roller 24 penetrates the soil 12 to be compacted, the ground contact force $F_b$ increases until the ground contact force $F_b$ reaches its maximum value $F_{bmax}$ at a time $t_3$. It can be clearly seen in FIG. 2 that, in the state of maximum ground contact force $F_{bmax}$, the force is not oriented exactly orthogonal to the soil 12, but is slightly inclined forward, which is substantially due to the fact that the soil compactor 10 moves forward in the direction of movement B during such a vibration cycle, and therefore the vibratory roller 24 penetrates the soil 12 at an oblique forward angle as it moves downward toward the soil 12. The direction corresponding substantially to the orientation of the maximum ground contact force $F_b$ is considered the working direction A. A direction orthogonal to it is considered as a normal direction N to the working direction A.

FIG. 2 further shows that, over one vibration cycle, the curve representing the development of the accelerations is shifted downward by a constant offset V representing this load factor due to the load of the front carriage 16 and also of the rear carriage 14 resting on the vibratory roller 24, wherein the load component acting constantly orthogonally to the surface of the soil 12 is also taken into account here.

Figure 3:
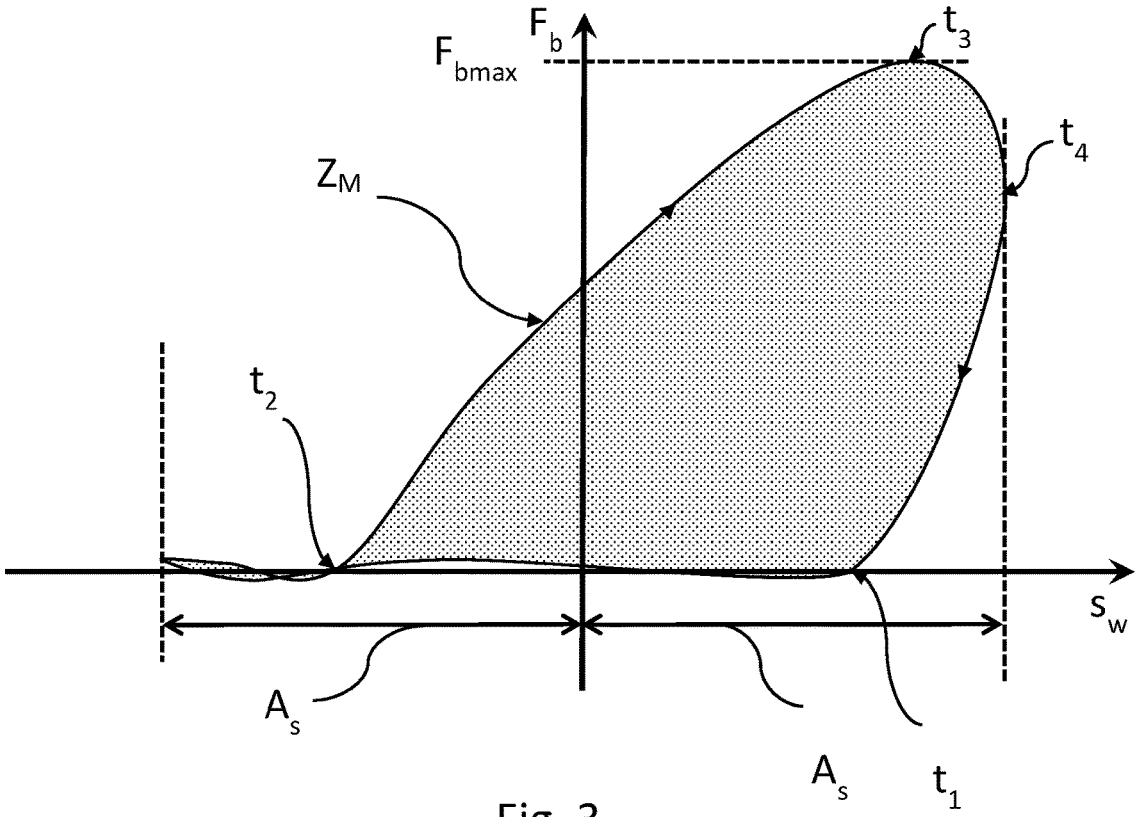
FIG. 3 is a working diagram derived from the diagram in FIG. 2, showing the ground contact force plotted over a vibration path of the vibratory roller in a working direction.

A vibration path representing the deflection $s_w$ of the vibratory roller 24 in the working direction A can be determined for each vibration cycle by double integration of the accelerations shown in the diagram of FIG. 2 for a vibration cycle or recorded by measurement. A measurement relationship $Z_M$ between the ground contact force $F_b$ and the deflection $s_w$ can be determined as shown in FIG. 3 from this deflection $s_w$ of the vibratory roller 24, which can be determined for each point in time of a vibration cycle, and the ground contact force $F_b$, which is also known for each point in time of the vibration cycle. This measurement relationship $Z_M$ represents a working diagram, wherein the area enclosed by the curve which represents the measurement relationship $Z_M$ represents the compaction work performed.

In the diagram of FIG. 3, the time $t_1$ again represents the time at which the vibratory roller 24 loses contact with the soil 12 and lifts off from it. At time $t_2$, the vibratory roller 24 comes back into contact with the soil 12. In the course of the then occurring penetration movement, the ground contact force $F_b$ increases until it reaches its maximum $F_{bmax}$ at time $t_3$. At time $t_4$, the state of maximum penetration into the soil 12 is reached and a reversal of the direction of movement occurs until the vibratory roller 24 lifts off the soil 12 again at time $t_1$. Thus, the vibratory roller 24 performs a movement having an amplitude $A_s$ with respect to a center of deflection $s_w$ in the working direction A in one vibration cycle.

The relationship shown in FIG. 3 can be analyzed to obtain information about the condition of the soil 12. For example, an approximate correlation with the stiffness or load stiffness of the soil and thus also the degree of compaction achieved can be established from the slope of the approximately linear course of the measurement relationship $Z_M$ between the times $t_2$ and $t_3$. As indicated above, the area enclosed by the measuring relationship $Z_M$ can be used to infer the compaction work and thus also the energy introduced into the soil 12. However, such analyses of a measurement relationship $Z_M$, as shown in FIG. 3, allow only a comparatively limited provision of information about the condition of the soil in the context of an area-wide dynamic compaction control, especially since a change in process parameters, such as the travel speed of the soil compactor 12, also leads to a change in this relationship and thus to different results of analysis.

The present invention aims at allowing a more comprehensive and precise statement about the condition of the soil 12 by taking into account such a measurement relationship $Z_M$ as shown for a vibration cycle in FIG. 3. The measures provided for this purpose in accordance with the invention are explained below.

Figure 4:
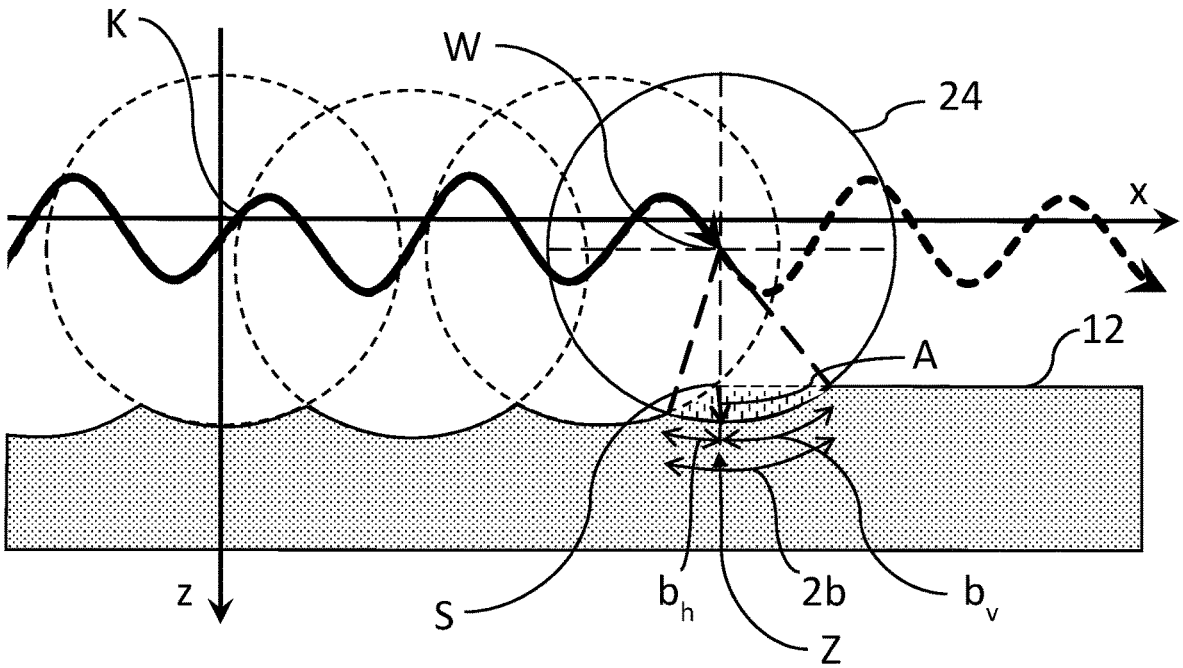
FIG. 4 shows the movement of the vibratory roller of the soil compactor of FIG. 1 over multiple vibration cycles.

FIG. 4 shows the movement of the vibratory roller 24 during multiple successive vibration cycles. It should be noted that such vibration cycles are comparatively short-lived events compared to the rolling motion of the vibratory roller 24. The imbalance arrangement 28 rotates at a speed of several tens of revolutions per second, whereas a complete revolution of the vibratory roller 24 generally takes several seconds as the soil compactor 10 moves in the direction of movement B. This means that during one complete revolution of the vibratory roller 24, the number of vibratory cycles may be in the range of 100 or more. This in turn means that the rolling motion or rotation of the vibratory roller 24 that occurs during each vibration cycle can be neglected.

In FIG. 4, the curve K shows the movement of the center point of the vibratory roller 24, i.e. the roller rotation axis W, in the course of successive vibration cycles in the horizontal direction x and the vertical direction z. This movement is substantially composed of the periodic up-down or forward-backward movement of the vibratory roller 24 caused by the operation of the imbalance arrangement 28 and the movement of the soil compactor 10, and thus also of the vibratory roller 24, in the direction of movement B, which substantially corresponds to an orbital movement of the roller rotation axis W. A movement pattern occurring in such a periodical lifting movement of the vibratory roller 24 can be clearly seen, in which pattern the vibratory roller 24 lifts off the soil 12 more strongly in every second vibration cycle than in a respective intermediate vibration cycle. Such a pattern of movement will occur primarily when a comparatively high degree of compaction of the soil 12 has been achieved. The vibratory roller 24 this can have the same course of movement in each period of the movement, i.e. also lift off from the soil 12 to substantially the same extent, in the case of comparatively little compacted soil 12. The course of the curve K can be determined mathematically from the accelerations $a_z$ and $a_x$ detected by the acceleration sensors 30, 32 and the speed at which the soil compactor 10 moves in the direction of movement B, which is also detected by measurement, for example. While the movement of the vibratory roller 24 caused by the movement of the imbalance arrangement 28 can be derived by double integration of the curve resulting from the measured accelerations, the movement in the direction of movement B superimposed on this movement can be determined by multiplying the known or detected speed of the soil compactor 10 by time, such that the location represented by the curve K and the direction of movement of the center of the compactor roller 24 are known for each point in time.

With the curve K determined taking into account the accelerations $a_z$ and $a_x$ and the speed of movement of the soil compactor 10 in the direction of movement B, or the movement of the vibratory roller 24 represented by this curve K during the successive vibration cycles, it becomes possible to calculate a contact perimeter length of the vibratory roller 24, represented in FIG. 4 by the variable **2*b*, for each vibration cycle in the course of a respective vibration cycle, i.e. during the penetration and the return movement of the vibratory roller 24 into or from the soil 10, taking into account the geometry of the soil 12** to be compacted.

FIG. 4 shows, based on the profile of the surface of the soil 12 indicated by a dashed line shown in the last vibration cycle, that this profile is substantially defined by a substantially straight section of the soil 12 not yet impacted by the vibratory roller 24 before the impact of the vibratory roller 24 on the soil 12 in the last vibration cycle shown, visible on the right, and a section curved like a segment of a circle, which results from the last complete vibration cycle and the deformation of the soil 12 that occurs in the process. The line of contact S of these two sections of the surface of the soil 10 represents the area in which, at time $t_2$, the vibratory roller 24 comes into contact with the soil 12 in the last vibration cycle shown.

Starting from an approximately linear contact in the area S over the entire axial length of the vibratory roller 24 or the roller shell 26 thereof, the contact perimeter length **2*b* increases in the course of the penetration movement of the vibratory roller 24 into the soil 12, i.e. substantially between the time $t_2$ and the time $t_4$ at which the maximum penetration depth is reached. The product of the contact perimeter length 2*b* and the axial length 2*a* of the roller shell 26 gives the area over which the vibratory roller 24 is in contact with the soil 12** to be compacted for each point in time of the penetration movement.

This area or the contact perimeter length **2*b* can be determined mathematically due to the fact that the curve K indicates how the vibratory roller 24 moves and that, as shown in FIG. 4, it is basically known or can be assumed which geometry the soil 12 has in the area in which the vibratory roller 24 comes into contact therewith during a respective vibration cycle. In a simplifying assumption, it can be assumed that the vibratory roller 24 comes into contact with the soil 12 uniformly over its axial length in the course of a vibration cycle and thus penetrates it uniformly. Further, as a simplifying assumption, it can be assumed that the soil 12 substantially retains its shape in the course of a complete vibration cycle after reaching time $t_1$ at the transition from a relief to a loss of contact in the measuring relationship $Z_M$ of FIG. 3. In the case of more complex models, it can also be taken into account metrologically or mathematically that the vibratory roller 24 wobbles, i.e. does not penetrate the soil 12 in the same way at both axial ends, which can be detected, for example, by providing respective sensors 30, 32 in association with both axial ends of the vibratory roller 24. It can then also be taken into account mathematically that the vibratory roller 24 penetrates the soil 12 to different extents over its axial length and thus different contact perimeter lengths 2*b* result over the length of the vibratory roller 24**.

FIG. 4 shows that the contact perimeter length **2*b* is basically divided into two perimeter length sections $b_h$ and $b_v$ which are not symmetrical with respect to a contact center Z, that is, do not have the same length. The contact center Z is defined, for example, by the area in which a line passing through the roller rotation axis W in the vertical direction z intersects the soil 12, for example in the state of maximum penetration. This asymmetry with regard to the lengths of the two perimeter length sections $b_h$ and $b_v$, which also results or can be derived from the calculation of the contact perimeter length 2*b*, provides information about the pushing effect of the vibratory roller 24 and also depends on the deformation behavior of the soil 12 and can thus be used to make a statement about the condition of the soil 12** during compaction. It should be noted that knowledge of this asymmetry can be obtained solely from measurable variables, namely the accelerations $a_z$ and $a_x$ and the speed of movement of the soil compactor in the direction of movement B, using mathematical calculation methods when taking into account the geometric conditions of the soil, without having to take into account any information that is not known with regard to the structure of the soil.

A physical model is established for the soil in the procedure according to the invention for providing information about the condition of the soil 12 to be compacted. In the Kelvin-Voigt ground model shown as an example in FIG. 5, the soil is represented by two force components. The force component $F_{b,k}$ corresponds to a spring force component, which is substantially represented by a spring stiffness $K_{(b)}$. The force component $F_{b,c}$ corresponds to a damper force component, which is substantially represented by a damping parameter $C_{(b)}$. The ground contact force $F_b$ which acts between the soil behaving according to this model and the vibratory roller 24 can thus be calculated as the sum total of the two force components $F_{b,k}$ and $F_{b,c}$.

For the ground model shown in FIG. 5, for example, the spring stiffness $K_{(b)}$ and the damping parameter $C_{(b)}$ can be taken into account in accordance with Wolf's cone model for compressible soils using the two formulas given below:

$$K_{(b)} = \frac{G \cdot b}{1-\nu} \cdot \left[3.1 \cdot \left(\frac{a}{b}\right)^{0.78} + 1.6\right] \tag{1}$$

$$C_{(b)} = 4 \cdot \sqrt{2 \cdot \rho \cdot G \cdot \frac{1-\nu}{1-2 \cdot \nu}} \cdot a \cdot b \tag{2}$$

In these formulas, the variable b corresponds to half the contact perimeter length 2*b*, the profile of which, as explained previously with reference to FIG. 4, can be determined mathematically for each vibration cycle from the time the vibratory roller 24 impacts the soil 12 until loss of contact is reached. The variable a corresponds to half the axial length 2*a* of the vibratory roller 24 or roller shell 26, such that the product of half the axial length a of the vibratory roller 24 and half the contact perimeter length b, which varies in the course of a penetration movement, is substantially a quarter of the contact area with which the vibratory roller 24 is in contact with the soil 12 at any point in time in the course of one vibration cycle. The quantity ν represents Poisson's ratio of the soil and can be assumed to have a value between 0 and about ⅓, assuming that the soil to be taken into account in the model is compressible. The quantity p corresponds to the density of the structural material of the soil, which is assumed to be approximately constant.

It should be noted at this point that other or additional variables, such as the mass of the soil, may also be taken into account if other models are used.

The variable G, also commonly referred to as the shear modulus, can be determined using the following formula:

$$G = \frac{E_{geo}}{2 \cdot (1+\nu)} \tag{3}$$

wherein the variable $E_{geo}$ represents the modulus of elasticity of the soil.

Taking into account these quantities a, b, ν, ρ, $E_{geo}$, the spring stiffness $K_{(b)}$ and the damping parameter $C_{(b)}$ can thus be determined using the formulas (1), (2) and (3) provided above. It can be seen in the above example of a ground model that the modulus of elasticity $E_{geo}$ or the shear modulus of the soil taking said variable into account is used as an essential variable characterizing the condition of the soil, in addition to the variables ρ, ν, a and b, which are assumed to be known or determined by calculation.

Figure 5:
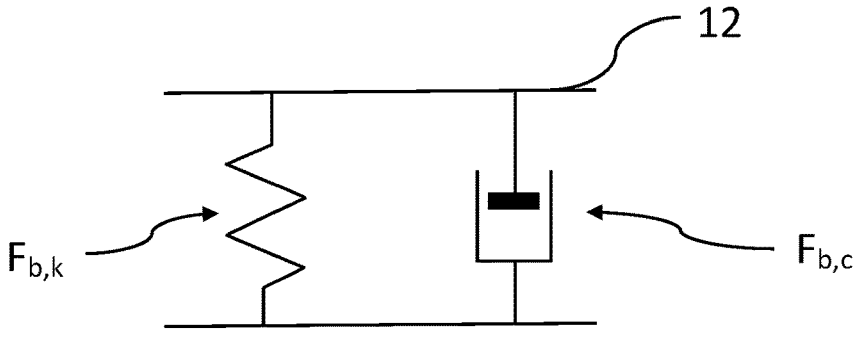
FIG. 5 shows a physical substitute model of a soil to be compacted.
Figure 6:
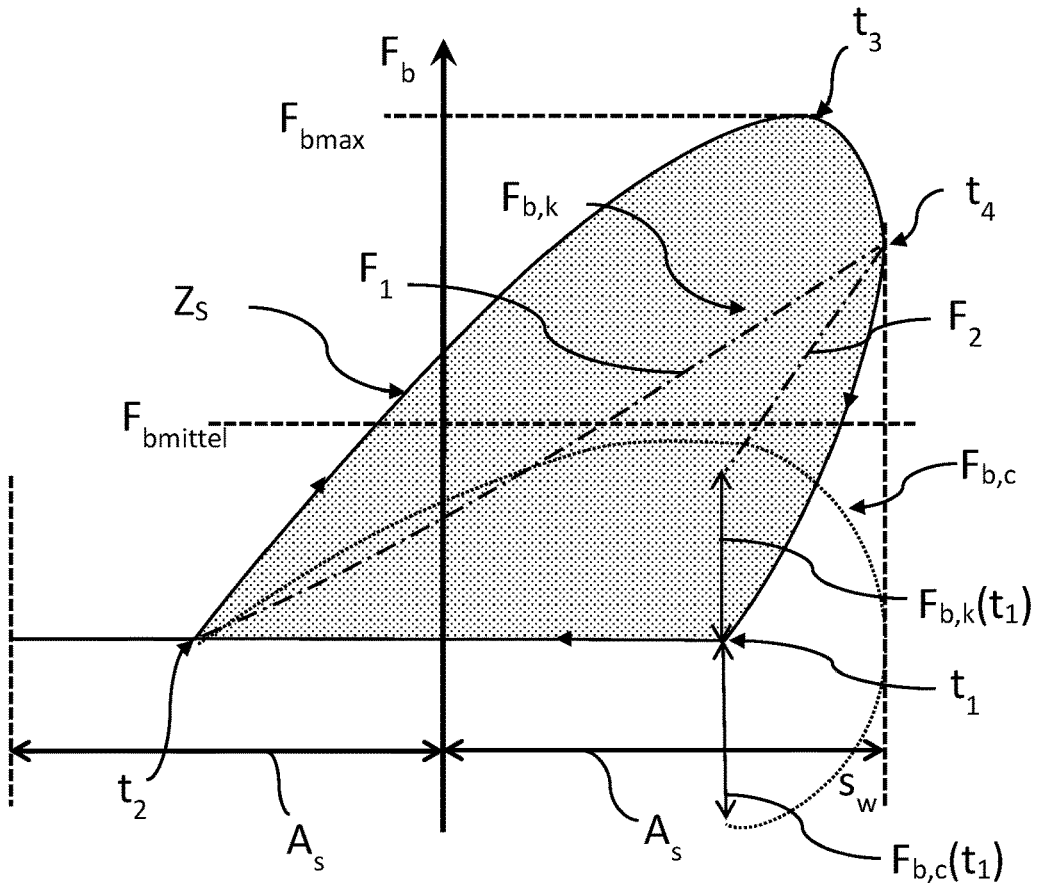
FIG. 6 shows a representation corresponding to FIG. 3 of a simulation relationship between the ground contact force and the vibration path of the vibratory roller in the working direction.

Using a plausible assumption for the value of the elastic modulus $E_{geo}$, a simulation relationship $Z_S$ shown in FIG. 6 can be determined, which relationship is based on the ground model shown in FIG. 5 and the variables spring stiffness $K_{(b)}$ and damping parameter $C_{(b)}$, which are assumed by way of example using the above formulas (1) to (3).

The force components $F_{b,k}$ and $F_{b,c}$ are calculated for one vibration cycle using the formulas (1) and (2) for the spring stiffness $K_{(b)}$ and the damping parameter $C_{(b)}$ to determine the simulation relationship $Z_S$ shown in FIG. 6, which reproduces the relationship between the ground contact force $F_b$ and the deflection $s_w$ of the vibratory roller 24 in the working direction A, for example by taking into account the ground model shown in FIG. 5 and represented by the formulas (1) to (3). In connection with the spring force component $F_{b,k}$, spring force component portions $F_1$ and $F_2$, each represented by a dash-dot-dash line, are determined for a phase between times $t_2$ and $t_4$ with increasing penetration depth and a phase between times $t_4$ and $t_1$ with decreasing penetration depth. This makes it possible to consider the fact that such a soil exhibits different stiffness behaviors in the loaded phase on the one hand and the relief phase on the other, which can be taken into account by introducing a relief stiffness factor for the relief phase, i.e. the phase of decreasing penetration depth between times $t_4$ and The spring force component portion $F_1$ for the loaded phase, i.e. the phase of increasing penetration depth between times $t_2$ and $t_4$, can be calculated by multiplying the spring stiffness $K_{(b)}$ by the vibration path in the working direction A over this phase between times $t_2$ and $t_4$. FIG. 6 clearly shows that a force profile is obtained which deviates from an exactly linear path. Likewise, the curve for the phase of decreasing penetration depth can be calculated between the times $t_4$ and $t_1$, wherein the relief stiffness factor already mentioned is also included by multiplying the product of spring stiffness $K_{(b)}$ and vibration velocity in the working direction A to be integrated over this time interval by the relief stiffness factor. As a boundary condition for the relief stiffness factor, it must be assumed that at the time when the contact between the vibratory roller 24 and the soil 12 ends, i.e. at time $t_1$, the spring force component $F_{b,k}$ and the damper force component $F_{b,c}$ compensate each other to achieve an equilibrium of forces.

The damping force component $F_{b,c}$ is obtained for a respective vibration cycle by integrating the product of damping parameter $C_{(b)}$ and vibration velocity in the working direction A, which may have to be multiplied by a damping factor to be selected depending on the material, and is shown in FIG. 6 by the dotted line between times $t_2$ and $t_1$. It can be clearly seen that at time $t_4$, i.e. when the vibratory roller 24 has penetrated the soil to the maximum extent, the damper force component $F_{b,c}$ is zero, since in this state the soil 12 is at rest and thus velocity-proportional forces become zero. Between times $t_4$ and $t_1$, i.e. when the load on the floor 12 is relieved, the damper force component $F_{b,c}$ counteracts the spring force component $F_{b,k}$ until these two force components $F_{b,k}(t_1)$ and $F_{b,c}(t_1)$ cancel each other out at time $t_1$.

The simulation relationship $Z_S$ shown in FIG. 6, which represents the relationship between the ground contact force $F_b$ and the displacement $s_w$ based on the ground model for one vibration cycle, is obtained by adding the spring force component $F_{b,k}$ and the damper force component $F_{b,c}$ for each phase of the vibration cycle. This results in a simulation relationship $Z_S$ which, as a comparison of FIGS. 3 and 6 clearly shows, is qualitatively comparable to the measurement relationship $Z_M$.

By suitable selection of the quantities entering the ground model, in particular the elasticity modulus $E_{geo}$, it becomes possible to influence or change the simulation relationship $Z_S$ in such a way that it substantially corresponds to the measurement relationship. For this purpose, the simulation relationship $Z_S$ can be determined successively using slightly changed input variables, particularly by changing the elasticity modulus $E_{geo}$, which represents an essential simulation parameter, and compared to the measurement relationship $Z_M$ in a best-fit process, for example. For this purpose, for example, the ground contact force $F_{bmean}$ averaged over the duration of at least one vibration cycle, the maximum ground contact force $F_{bmax}$ in the vibration cycle and the area delimited by the curve representing a respective relationship $Z_M$ or $Z_S$ can be compared with each other as comparison parameters. It should be noted that the average ground contact force $F_{bmean}$ is substantially equal to the static load exerted over the vibratory roller, since on average the soil compactor does not move upwards or downwards.

If a deviation is detected for each of these comparison parameters that is below a respective predetermined threshold for it, it is determined that these two relationships $Z_S$ and $Z_M$ substantially match each other, i.e. the deviation between them falls below a predetermined deviation threshold. Thus, it can be determined that the ground model used to obtain such a simulation relationship, with the simulation parameters taken into account in the process, reproduces the soil compacted by the soil compactor 10 with high accuracy. It can then further be determined that one or more of the simulation parameters taken into account in the model, such as the elastic modulus $E_{geo}$, actually represents the corresponding soil parameter of the soil 12. In this state, such a simulation parameter can then be stored as a parameter representing the condition of the soil in the context of an area-wide dynamic compaction control. Other variables taken into account in the ground model in the process, such as the relief stiffness factor or the damping factor, can also be stored in connection with the modulus of elasticity as parameters describing the soil, of course in connection with the location at which the soil compactor 10 is located during a respective vibration cycle. Other variables, such as the asymmetry of the contact perimeter length 2*b* mentioned above, can also be recorded for evaluation or assessment of the quality of the soil 12.

Other variables, such as the settlement of the soil 12, i.e. the difference in height between the soil 12 before the contact with the vibratory roller 24 and afterwards, or the contact stress resulting from incremental summation of the acting force or the existing contact area, can also be determined and recorded with the procedure according to the invention based on the calculation of the penetration movement of the vibratory roller 24 into the soil 12 described above, or taken into account in the determination of the simulation relationship $Z_S$ and, for example, also be varied as simulation parameters. Furthermore, the phase position or also the direction of rotation of the imbalance arrangement 28 can be derived from the variables determined or calculated in the procedure according to the invention, for example from the acceleration of the vibratory roller 24 in the normal direction N, which is orthogonal to the working direction A, for example if this is not measured. Alternatively or additionally, in particular for providing information about the phase position, i.e. the rotational positioning, of the imbalance arrangement 28, the latter can be associated with a sensor the output signal of which reflects the phase position and thus also the direction of rotation of the imbalance arrangement 28. This information can also be used, for example, in the creation of the measurement relationship $Z_M$ shown in FIG. 3.

To bring the simulation parameters, such as the modulus of elasticity $E_{geo}$, determined in the comparison of the simulation relationship $Z_S$ to the measurement relationship $Z_M$ as representing a respective soil parameter, into even better agreement with the actual condition of a soil, as described above, a correlation between a simulation parameter determined in this way and the value of the respective soil parameter actually present in a soil compacted in the process can be determined in field or laboratory tests in the form of a correlation factor linking these two variables. Such a correlation factor can then also be taken into account within the framework of the area-wide dynamic compaction control by linking it with the respective simulation parameter, i.e. multiplying it, for example, in order to be able to generate a parameter that reflects the actual value of the respective soil parameter with high precision.

Finally, it should be pointed out that the procedure according to the invention for determining parameters which have a high degree of accuracy in providing information about the condition of a compacted soil can be used for a wide variety of substrates to be compacted. For example, the procedure according to the invention can be used for compacting asphalt, as well as for compacting the soil to be placed under an asphalt layer. In principle, this procedure can be applied to all granular or plastic soil materials that can be compacted by means of such a soil compactor operating with a vibratory roller.

It should also be noted that the procedure according to the invention can also be used to not only permanently determine and record respective parameters associated with compaction locations in real time during the execution of a soil compaction process, but also to operate the soil compactor carrying out the soil compaction process in feedback in such a way that the compaction result is optimized taking into account the determined condition of the soil. If it is detected during a compaction process using the procedure according to the invention that sufficient compaction has not yet been achieved in specific areas, such areas can be passed over more frequently or repeatedly by controlling the soil compactor accordingly, while areas in which there is already a sufficient degree of compaction do not need to be passed over any further. Thus, a control of the compaction operation can be carried out, in which the soil compactor is either automatically moved by an automated control system to specific areas of a soil to be compacted, or the operator operating a compactor is provided with information about where the soil is to be compacted and in which way, or where it is no longer to be compacted. For example, such information may be graphically displayed on the display unit 22.

In summary, the method according to the invention for providing information related to the compaction state of a soil when performing a compaction operation with a soil compactor can be presented as follows:

a) detecting a vertical acceleration and a horizontal acceleration of a vibratory roller when moving a soil compactor over a soil to be compacted, for example by means of one or more imbalance sensors, b) determining a measurement relationship between a ground contact force and a deflection of the vibratory roller for one vibration cycle using the vertical acceleration and horizontal acceleration detected in operation a), c) determining a simulation relationship between the ground contact force and the deflection for at least one vibration cycle using a ground model taking into account at least one simulation parameter, d) comparing the simulation relationship to the measurement relationship, e) determining that a default value of the at least one simulation parameter taken into account in the ground model substantially represents a corresponding soil parameter of the soil to be compacted when the simulation relationship substantially corresponds to the measurement relationship.

The invention claimed is:

1. A method for providing information related to the compaction state of a soil when carrying out a compaction process with a soil compactor, wherein the soil compactor comprises at least one vibratory roller with an imbalance arrangement rotating about a roller rotation axis of the at least one vibratory roller, wherein in association with the at least one vibratory roller an acceleration detection arrangement is provided for detecting a vertical acceleration of the vibratory roller substantially orthogonal to the soil to be compacted and a horizontal acceleration of the at least one vibratory roller substantially parallel to the soil to be compacted, comprising the operations:

a) detecting the vertical acceleration and the horizontal acceleration of the at least one vibratory roller when the soil compactor moves over the soil to be compacted, b) determining a measurement relationship between a ground contact force and a deflection of the vibratory roller for at least one vibration cycle using the vertical acceleration and horizontal acceleration detected in operation a), c) determining a simulation relationship between the ground contact force and the deflection for at least one vibration cycle using a ground model taking into account at least one simulation parameter, d) comparing the simulation relationship determined in operation c) for at least one vibration cycle to the measurement relationship determined in operation b) for at least one vibration cycle, e) determining that a default value of the at least one simulation parameter taken into account in the ground model substantially represents a corresponding soil parameter of the soil to be compacted, if the comparison performed at operation d) shows that the simulation relationship determined for at least one vibration cycle substantially corresponds to the measurement relationship determined for at least one vibration cycle.

2. The method according to claim 1, wherein operations b) and c) take into account the deflection in a working direction of the vibratory roller corresponding substantially to a direction of the maximum ground contact force.

3. The method according to claim 1, wherein operation c) comprises an operation c1) for determining a contact perimeter length of the vibratory roller in the course of a vibration cycle, and that the contact perimeter length forms a simulation parameter of the ground model.

4. The method according to claim 3, wherein, in operation c1), the contact perimeter length (2*b*) is determined based on the vertical acceleration and horizontal acceleration determined in operation a) and based on a movement speed of the soil compactor in a movement direction of the soil compactor.

5. The method according to claim 3, wherein, in operation c1), the contact perimeter length is determined with a front perimeter length section preceding a contact center in a movement direction of the soil compactor and a rear perimeter length section trailing the contact center in the movement direction of the soil compactor, and in that an asymmetry parameter representing the condition of the soil is formed based on a length of the front perimeter length section and a length of the rear perimeter length section.

6. The method according to claim 1, wherein a soil elasticity modulus forms a simulation parameter of the ground model.

7. The method according to claim 6, wherein the ground model takes into account a ground deformation behavior represented at least by a spring force component and a damper force component, and in that operation c) comprises an operation c2) for determining the spring force component and an operation c3) for determining the damper force component.

8. The method according to claim 7, wherein the spring force component is determined as a function of the soil elasticity modulus and the contact perimeter length in operation c2), or/and in that the damper force component is determined as a function of the soil elasticity modulus and the contact perimeter length in operation c3).

9. The method according to claim 7, wherein, in operation c2), the spring force component is determined for one vibration cycle with a first spring force component portion for a phase with increasing penetration depth of the vibratory roller into the ground and with a second spring force component portion for a phase with decreasing penetration depth of the vibratory roller.

10. The method according to claim 9, wherein, in operation c2), the second spring force component portion is determined taking into account a relief stiffness factor in such a way that in a transition from the phase of decreasing penetration depth of the vibratory roller to an out-of-contact phase, the spring force component and the damper force component compensate each other substantially completely, wherein in the out-of-contact phase the at least one vibratory roller is substantially not in contact with the soil to be compacted, wherein the relief stiffness factor can form a stiffness parameter representing the condition of the soil.

11. The method according to claim 10, wherein operation c) comprises an operation c4) for determining the ground contact force for a vibration cycle based on the spring force component determined in operation c2) and the damper force component determined in operation c3).

12. The method according to claim 1, wherein, if detected during operation e) that the deviation of the simulation relationship from the measurement relationship does not fall below a predetermined deviation threshold, the operations c) to e) are repeated while changing at least one simulation parameter when operation c) is carried out until the deviation of the simulation relationship from the measurement relationship falls below the predetermined deviation threshold.

13. The method according to claim 1, wherein a correlation factor is determined between the simulation parameter determined in operation e) as substantially representing the corresponding soil parameter and a measured value of the soil parameter of the compacted soil, or in that the simulation parameter determined in operation e) as substantially representing the corresponding soil parameter is linked to a correlation factor to obtain an actual value of a soil parameter.

14. The method according to claim 1, wherein operations a) to e) are repeatedly carried out during the movement of the soil compactor when carrying out a compaction operation.

15. The method according to claim 1, wherein, during a compaction process, a data set is generated with a plurality of positions on the soil to be compacted and the value determined in association therewith of the at least one simulation parameter determined when carrying out operations a) to e) as substantially representing a soil parameter.

* * * * *